US009648407B2

(12) United States Patent
Harper

(10) Patent No.: US 9,648,407 B2
(45) Date of Patent: May 9, 2017

(54) SYSTEM AND METHOD FOR MANAGING HEADPHONE WIRES

(71) Applicant: Kaddan Entertainment, Inc., New York, NY (US)

(72) Inventor: Patrick Sean Harper, New York, NY (US)

(73) Assignee: Kaddan Entertainment, Inc., New York, NY (US)

( * ) Notice: Subject to any disclaimer, the term of this patent is extended or adjusted under 35 U.S.C. 154(b) by 0 days.

(21) Appl. No.: 14/735,470

(22) Filed: Jun. 10, 2015

(65) Prior Publication Data

US 2015/0365755 A1 Dec. 17, 2015

Related U.S. Application Data

(60) Provisional application No. 62/011,127, filed on Jun. 12, 2014.

(51) Int. Cl.
*H04R 25/00* (2006.01)
*H04R 1/10* (2006.01)

(52) U.S. Cl.
CPC ..... *H04R 1/1033* (2013.01); *H04R 2460/17* (2013.01)

(58) Field of Classification Search
CPC .... H04R 1/1033; H04R 1/1016; H04R 1/105; H04R 5/033; H04R 1/1066; H04R 1/1075; H04R 2201/023; H04R 5/0335
USPC ..... 381/380, 384, 394, 74; 181/129
See application file for complete search history.

(56) References Cited

U.S. PATENT DOCUMENTS

| | | | |
|---|---|---|---|
| 2,506,490 | A | 5/1950 | Coley |
| 3,129,477 | A | 4/1964 | Mizuno |
| 3,875,592 | A | 4/1975 | Alieo |
| 4,231,137 | A | 11/1980 | Fujimoto |
| 4,499,593 | A | 2/1985 | Antle |

(Continued)

FOREIGN PATENT DOCUMENTS

| | | | |
|---|---|---|---|
| CN | 2497497 | Y | 6/2002 |
| DE | 20006606 | U1 | 10/2000 |

(Continued)

OTHER PUBLICATIONS

International Search Report and Written Opinion for PCT/US2015/035122 dated Dec. 17, 2015, 14 pages.

(Continued)

*Primary Examiner* — Paul S Kim
*Assistant Examiner* — Norman Yu
(74) *Attorney, Agent, or Firm* — Rothwell, Figg, Ernst & Manbeck, p.c.

(57) ABSTRACT

An apparatus for securing headphone/earbud/transducer wires through a clasping structure created when the earbuds are connected. The coupling of the headphones may create a clasping structure whereby the headphone wire can be coiled and then held in place, preventing the wires from knotting or tangling. When the headphones are connected to one another, there may exist a space between them, serving as a closed loop around the coiled headphone wires. When the headphones are unconnected, however, no such loop exists. The width of the loop may be approximately the same thickness of the coiled headphone wires so that friction holds the wires in place.

29 Claims, 8 Drawing Sheets

(56) References Cited

U.S. PATENT DOCUMENTS

| | | | | |
|---|---|---|---|---|
| 4,535,870 | A | 8/1985 | Lindsay | |
| 5,036,681 | A | 8/1991 | Schaerer | |
| 5,110,198 | A | 5/1992 | Travis et al. | |
| 5,432,986 | A | 7/1995 | Sexton | |
| 5,572,887 | A | 11/1996 | Geswelli | |
| 5,737,436 | A | 4/1998 | Boyden | |
| 5,806,346 | A | 9/1998 | Schlinger et al. | |
| 5,832,098 | A | 11/1998 | Chen | |
| 5,845,197 | A | 12/1998 | Hada et al. | |
| 5,933,507 | A | 8/1999 | Woolley et al. | |
| 6,154,890 | A | 12/2000 | Deopuria | |
| 6,374,126 | B1 | 4/2002 | MacDonald, Jr. et al. | |
| 6,438,248 | B1 | 8/2002 | Kamimura et al. | |
| 6,473,946 | B1 | 11/2002 | Cheng | |
| 6,481,065 | B2 | 11/2002 | Cogdill | |
| 6,568,805 | B1 | 5/2003 | Dietz | |
| 6,598,272 | B2 | 7/2003 | Nire | |
| 6,640,398 | B2 | 11/2003 | Hoffman | |
| 6,679,828 | B2 | 1/2004 | Kaufman et al. | |
| 6,712,304 | B1 | 3/2004 | Taylor | |
| 6,721,579 | B2 | 4/2004 | Liu | |
| 6,833,507 | B2 | 12/2004 | Arkin et al. | |
| 6,845,158 | B2 | 1/2005 | Koester et al. | |
| 6,981,391 | B2 | 1/2006 | Suzuki | |
| 7,013,492 | B2 | 3/2006 | Hugh et al. | |
| 7,184,565 | B2 | 2/2007 | Ohta | |
| 7,372,974 | B2 | 5/2008 | Yanagishita et al. | |
| 7,436,974 | B2 | 10/2008 | Harper | |
| 7,477,922 | B2 | 1/2009 | Lewis | |
| 7,558,398 | B2 | 7/2009 | Ito et al. | |
| 7,693,295 | B2 | 4/2010 | Harper | |
| 7,995,783 | B2 | 8/2011 | Ledbetter et al. | |
| 8,121,304 | B2 * | 2/2012 | Bales | H04R 1/1033 381/374 |
| 8,189,843 | B2 | 5/2012 | Harper | |
| 2002/0076060 | A1 | 6/2002 | Hall et al. | |
| 2002/0131614 | A1 | 9/2002 | Jakob et al. | |
| 2003/0169896 | A1 | 9/2003 | Kirk, III et al. | |
| 2004/0042629 | A1 | 3/2004 | Mellone et al. | |
| 2004/0096079 | A1 | 5/2004 | Chang et al. | |
| 2004/0170294 | A1 | 9/2004 | Murozaki et al. | |
| 2005/0025329 | A1 | 2/2005 | Lee | |
| 2005/0131560 | A1 | 6/2005 | Quat et al. | |
| 2006/0013429 | A1 | 1/2006 | Ohta | |
| 2006/0239491 | A1 | 10/2006 | Ito | |
| 2008/0037817 | A1 | 2/2008 | Ewert et al. | |
| 2008/0159581 | A1 | 7/2008 | Ito et al. | |
| 2010/0284525 | A1 | 11/2010 | Sander et al. | |
| 2011/0044487 | A1 | 2/2011 | Nault | |
| 2011/0110552 | A1 * | 5/2011 | Pang | H04R 1/1033 381/374 |
| 2013/0028461 | A1 * | 1/2013 | Harper | H04R 1/1033 381/374 |

FOREIGN PATENT DOCUMENTS

| | | | |
|---|---|---|---|
| EP | 1341361 | A2 | 9/2003 |
| EP | 1509062 | A1 | 2/2005 |
| EP | 2339866 | A1 | 6/2011 |
| FR | 2808961 | | 11/2001 |
| JP | 55-133822 | | 3/1979 |
| JP | S62-167486 | | 10/1987 |
| JP | 04-14399 | | 1/1992 |
| JP | H4-64894 | | 6/1992 |
| JP | H6-26390 | | 4/1994 |
| JP | 07211146 | | 8/1995 |
| JP | 07-211146 | | 11/1995 |
| JP | H9-84169 | | 3/1997 |
| JP | 09307981 | | 11/1997 |
| JP | 2001-237939 | | 8/2001 |
| JP | 200456636 | A | 2/2004 |
| KR | 101393844 | B1 | 5/2014 |
| WO | 0101657 | A1 | 1/2001 |
| WO | 0187006 | A2 | 11/2001 |
| WO | 03086929 | A1 | 10/2003 |
| WO | 03103255 | A1 | 12/2003 |
| WO | 2004071056 | A1 | 8/2004 |
| WO | 2005086524 | A1 | 9/2005 |
| WO | 2010132501 | A2 | 11/2010 |

OTHER PUBLICATIONS

Magnet, from Wikipedia, May 21, 2015, 18 pages.

Arnazon.com: Sennheiser MX 70 Sport Stereo Earbuds with Magnetic Surfaces, www.amazon.com/Sennheiser-MX-70-Magnetic-Surfaces/dp/B000F JEYZ8, Sep. 5, 2013, 5 pages.

Sennheiser Electronic GmbH & Co., KG Soundings 1/05, vol. 8, 2005, 36 pages.

Sennheiser Electronic GmbH & Co., KG, Soundings 1/04, vol. 7, 2004, 32 pages.

Sennheiser Electronic GmbH & Co., KG, Soundings 1/06, vol. 9, 2006, 28 pages.

* cited by examiner

SYSTEM AND METHOD FOR MANAGING HEADPHONE WIRES

CROSS-REFERENCE TO RELATED APPLICATION

The present application claims the benefit of priority to U.S. Provisional Application Ser. No. 62/011,127, filed on Jun. 12, 2014, which is incorporated herein by reference in its entirety.

BACKGROUND

Field of Invention

The present invention relates generally to a headphone apparatus capable of managing headphone wires. Specifically, the present invention may relate to a headphone apparatus having transducer coupling devices that, when engaged, create a structure capable of securing one or more headphone wires.

Discussion of Background

All United States patents and publications referred to herein are hereby incorporated by reference in their entireties into the present application. In particular, U.S. Pat. Nos. 6,616,080; 7,077,693; 7,436,974; 7,693,295; 8,121,304; 8,139,809; 8,189,843; 8,798,305; 8,908,898; 8,976,993; and D709,355; and U.S. Patent Application Publications Nos. 2014/0169611, and 2011/0252605 are hereby incorporated by reference in their entireties. In the case of conflict, the present specification, including any definitions, will control.

The use of portable audio and video devices, including smartphones, has grown rapidly as a way for people to listen to various audio mediums while on the go. These devices require some sort of audio transducer/headphone to convert the electrical signals from the portable device into audible sound. These signals are usually transmitted by means of a signal wire or cord physically connected to the device, but could also be transmitted wirelessly. Many designs of these "headphones" exist but increasingly popular are earbud/in-ear headphones that are small, light weight and easy to carry or store when not being used. These earbud headphones are usually connected to one another by means of secondary wires, which transmit the portable device signal to both the right and left headphone transducers. In each earbud housing, there is typically at least one headphone transducer to convert the device signal into audio. The earbud housing may include housing for at least a portion of a wire connected to the headphone transducer, and may have multiple parts and shapes to it, including, but not limited to a structure designed to fit the shape of a user's ear or ear canal, a decorative or ornamental structure, a shroud, or a stem.

While earbud headphones are lightweight and portable, the headphone wires are flexible and can often become tangled or knotted when they are stored away, such as in a pocket or bag. When the wires become tangled or knotted, the user must take time and effort to untangle or unknot them before being able to use the headphones properly. Additionally, this tangling or even the process of untangling the headphones can cause damage to the wires, eventually causing the headphones no longer to function. There are techniques users may employ to coil or wrap the wire and then intentionally knot the wire around itself so that it does not become further tangled. These techniques require user knowhow but also add complexity to un-wrapping the headphones because the user must undo the intentional knot.

In addition, certain cord management systems exist whereby a portion of the headphone wire is formed into elastic helical coil shape to help facilitate this folding of the wire, such as the system described in U.S. Pat. No. 8,908,898, as noted above. This embodiment, however, causes the tying portion of the wire to be bulkier, changes its aesthetic properties, and causes it to facilitate tangling with the rest of the wires if the tying portion is not properly engaged with a folded wire.

Similarly, certain cord management systems exist which allow the user to wrap a wire around them and temporarily secure it to prevent tangling. Such systems are described, for example, in the U.S. Pat. No. 7,077,693, as noted above. Some of these systems include an embedded winding mechanism to help the user spool the wire, such as the system described in U.S. Pat. No. 6,616,080, as noted above. Other cord management systems exist that wrap around the coiled headphone wires, securing them in place by means of friction thereby preventing them from tangling. Such systems are described, for example, in U.S. Patent Application Publication No. 2011/0252605, as noted above. Each of these embodiments requires an additional device, which adds significant size and weight to the headphones or must be carried separately.

Other cord management systems exist that do not require an additional spooling device but rather use the headphones' bodies as a spooling device. These embodiments, however, require an additional cord fastener to be engaged with the wire, which adds significant size and weight to the headphone wires and changes their aesthetic properties. Furthermore, this system makes returning the headphones to a usable state a three-step process: 1) unclasp the fastener, 2) uncoil the cord, 3) pull the headphone ear pieces apart. Such systems are described, for example, in U.S. Patent Application Publication No. 2014/0169611, as noted above.

Certain headphones are designed to be connected by means of a coupling device so that the user may wear the headphones around the neck when they are not in use. Such systems are described, for example, in U.S. Pat. Nos. 7,436,974; 7,693,295; 8,189,843; 8,798,305; and 8,976,993, as noted above. In addition to connecting the headphones around the user's neck, the user may connect the headphones before storing them away in a pocket or a bag, for example. Connecting the headphones helps prevent the two secondary wires from tangling with one another by creating a complete wire loop with no unconnected ends of the earbud wires. While coupling the headphones in this way does provide a way to partially prevent tangling, the earbud wires may still become entangled with the signal wire, creating knots the user must still unknot or untangle.

Certain cord management systems exist to further secure the signal wire, but they require at least one additional cable management clip device, which adds significant size and weight to the headphone wires, changes their aesthetic properties and introduces the potential for further tangling when the clip device is not properly engaged. Such systems are described, for example, in the U.S. Pat. No. 8,139,809, as noted above.

Furthermore, certain cord management systems exist which are designed to allow the user to connect each end of the headphone wires (the headphones) and signal wires (the plug) together. Connecting the headphones and plug helps prevent the two secondary wires and one signal wire from tangling with each other by creating a complete wire loop with no unconnected ends of the earbud wires. While connecting the headphones and plug in this way provides a way to partially prevent tangling among the earbud and signal wires, it does not completely prevent tangling as much of the wire is still unconstrained. It does not provide a way to constrain the wire at points other than its ends, still allowing the unsecured wire to become entangled with or snagged on other objects, e.g., keys in one's pocket or the wire from another device in a laptop bag. Some such systems may require a connection device, i.e., magnets or snaps, at the ends of each of the earbud and signal wires. Having several connection devices adds bulk, changes its aesthetic properties and makes it so returning the headphones to a usable state is at least a two-step process: 1) disconnect the signal wire connection device, 2) pull the earphone connection devices apart. Such systems are described, for example, in U.S. Pat. No. 8,121,304, as noted above. Other such systems require the use of an additional device which adds significant size and weight to the headphones or must be carried separately, creating the possibility that it will be lost. Such systems are described, for example, in U.S. Pat. No. D709,355, as noted above.

There is presently a need in the art for a system or systems to more-effectively prevent the earbud/headphone wires from tangling or knotting, thereby saving the user time and hassle required to untangle the wires.

SUMMARY

The present invention may provide, among other advantages, a headphone apparatus that enables a headphone wire to be secured in such a way that prevents knotting and tangling and may not require an additional device to do so. In one aspect, the invention may provide a earbud/headphone apparatus including a first transducer and a second transducer, a first coupling device and a second coupling device, a first transducer wire and a second transducer wire, and a signal wire. The first and second transducer wires may be connected to the first and second transducers, respectively, and may merge with the signal wire. The signal wire may be capable of being connected to a portable device by an audio connector, which may be attached to the signal wire. The first and second coupling devices may include first and second clips, respectively. When the coupling devices are connected in a specific orientation, the first and second clips may form a loop which can be used to hold coiled headphone wires in place, preventing the headphone wires from tangling. The loop formed when the coupling devices are connected may be fully closed or may leave a small space between each clip, though such space may be less than the diameter of any of the headphone wires and/or audio connector.

In one embodiment, when the coupling devices are connected in a specific orientation, the clips may grip the coiled wires by means of friction, holding them in place. Generally, headphone wires are encased by a flexible material such as rubber or fabric, which can be compressed under moderate pressure, thereby reducing the diameter of the headphone wire. In one embodiment, the loop formed by the connection of the coupling devices and the clips may be smaller than the diameter of the coiled headphone wires, thereby slightly compressing them in the way described above, further securing them in place through the friction between the clips and the wire. In another embodiment, the loop formed by the connection of the coupling devices and the clips may be smaller than the diameter of the audio plug, so that should the wire overcome the force of friction and move freely within the loop, the end of the wire with the audio plug will not be able to pass through the loop, thereby keeping the coiled wires secured. In another embodiment, the loop formed by the connection of the coupling devices and the clips may be used to grip the audio plug by means of friction, thereby securing both the plug and the wire.

In a further embodiment, the coupling devices may comprise a means of maintaining the specific orientation needed to create the loop. For example, each coupling device may comprise a magnet creating a non-uniform magnetic field, such as the field created by a magnet with an elongated or rectangular surface. Alternatively, one coupling device may comprise two or more magnets with differing polarities, such that magnets on the other coupling device are of complimentary polarities, thereby allowing the two coupling devices to connect in one orientation when in close proximity. In some embodiments, any coupling device may comprise a guiding structure whereby complimentary extrusions and depressions would keep the coupling devices at one or more specific orientations when connected.

In some embodiments, the clips may be integrated into the shape of the transducers themselves. In these embodiments, the first transducer and second transducer may act as the first and second half of the clip, respectively. When the coupling devices are connected in a specific orientation, the first and second transducers may form a loop between the transducers which may be used to hold the coiled headphone wires in place, preventing them from tangling. The loop the transducers form when the coupling devices are connected may be fully closed or may leave a small space between each clip, though such space may not be greater than the diameter of any of the headphone wires. The loop may be formed, in part, by the coupling devices, or entirely by the shape of the headphones themselves.

One aspect of the invention may provide a headphone apparatus including a wire, a first transducer, and a second transducer. The first transducer may have a first mechanical housing. The first mechanical housing may include a first coupling device. The second transducer may have a second mechanical housing. The second mechanical housing may include a second coupling device configured to engage with the first coupling device. The first and second coupling devices may be configured such that engagement of the first and second coupling devices secures the first and second transducers to each other. The first and second coupling devices may be configured such that engagement of the first and second coupling devices creates a structure capable of securing the wire.

In some embodiments, the first coupling device may be attached to an interior or exterior surface of the first mechanical housing, or otherwise integrated with it. In some embodiments, the second coupling device may be attached to an interior or exterior surface of the second mechanical housing, or otherwise integrated with it.

Another aspect of the invention may provide a headphone apparatus including a wire, a first transducer, a second transducer, a first coupling device, and a second coupling device. The first transducer may have a first mechanical housing. The second transducer may have a second mechanical housing. The second coupling device may be configured to engage with the first coupling device. The first and second coupling devices may be configured such that engagement of the first and second coupling devices creates a structure capable of securing the wire. In some embodiments, the first coupling device may be connected to a surface of or integrated into the first mechanical housing, and the second coupling device may be connected to a surface of or integrated into the second mechanical housing.

Still another aspect of the invention may provide a method for securing a headphone wire of a headphone apparatus having a first transducer including a first coupling device and a second transducer including a second coupling device. The method may include coiling the headphone wire. The method may include securing the coiled headphone wire by engaging the first and second coupling devices. The engagement of the first and second coupling devices may (i) secure the first and second transducers to each other and (ii) create a structure capable of securing the wire.

Another aspect of the invention may provide a system of modifying preexisting headphone transducers. The system may include a first attachment apparatus and a second attachment apparatus. The first attachment apparatus may be configured to be permanently or removeably attached to a mechanical housing of a first headphone transducer. The first attachment apparatus may include a first coupling device. The second attachment apparatus may be configured to be permanently or removeably attached to a mechanical housing of a second headphone transducer. The second attachment apparatus may include a second coupling device. The second coupling device may be configured to engage with the first coupling device. The first and second coupling devices may be configured such that engagement of the first and second coupling devices creates a structure capable of securing a wire connected to at least one of the first and second headphone transducers.

A further aspect of the invention may provide a headphone apparatus including a signal wire, a first transducer, a second transducer, a first transducer wire, and a second transducer wire. The first and second transducers may be connected to the first and second transducer wires, respectively. The first transducer may include a first coupling device. The second transducer may include a second coupling device. The second coupling device may be configured to engage with the first coupling device. The first and second coupling devices may be configured such that engagement of the first and second coupling devices creates a structure capable of securing the signal wire. The first and second coupling devices may be configured such that engagement of the first and second coupling devices secures at least a portion of the first and second transducer wires to each other. The first and second coupling devices may be attached to or integrated with the first and second transducer wires, respectively.

In some embodiments, when the user wishes to resume using the headphones, he may simply pull the coupling devices apart, a one-step process. In some embodiments, with the wire no longer secured and the transducers disconnected, the wire may fall neatly to an untangled state, and the user can put the transducers in his ears.

Further variations encompassed within the systems and methods are described in the detailed description of the invention below.

BRIEF DESCRIPTION OF THE DRAWINGS

The accompanying drawings, which are incorporated herein and form part of the specification, illustrate various, non-limiting embodiments of the present invention. In the drawings, like reference numbers indicate identical or functionally similar elements.

DETAILED DESCRIPTION

Figure 1A:
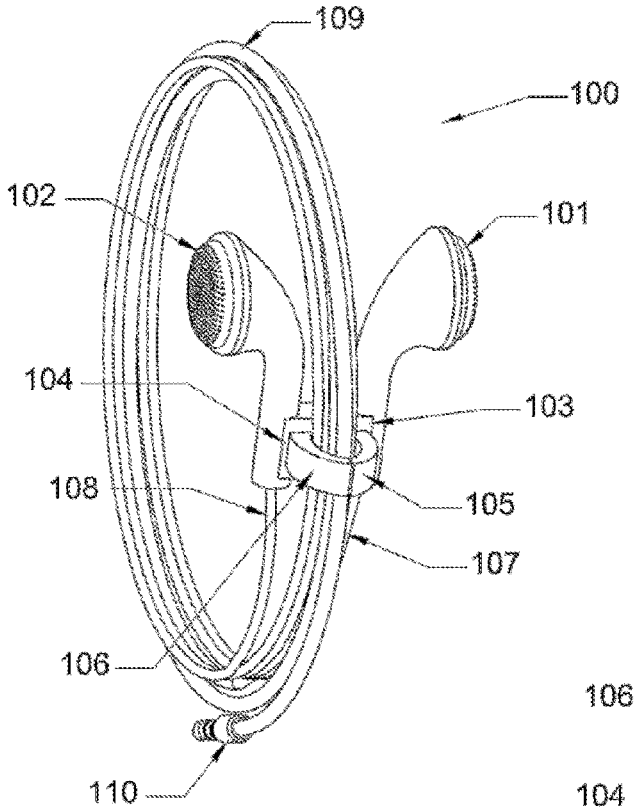
FIGS. 1A and 1B are perspective and side views, respectively, illustrating a headphone apparatus embodying aspects of the present invention with first and second coupling devices securing first and second transducers together and clips on the coupling devices securing the headphone wire.
Figure 1B:
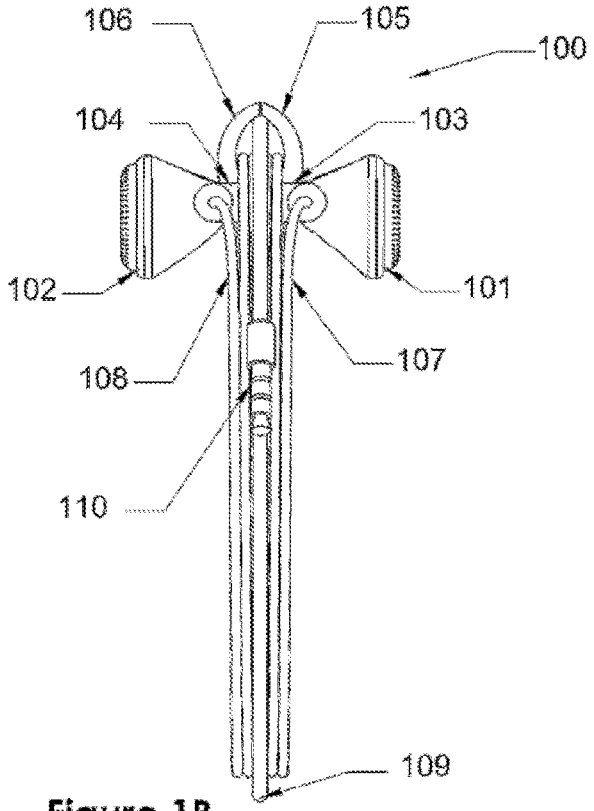
Figure 2:
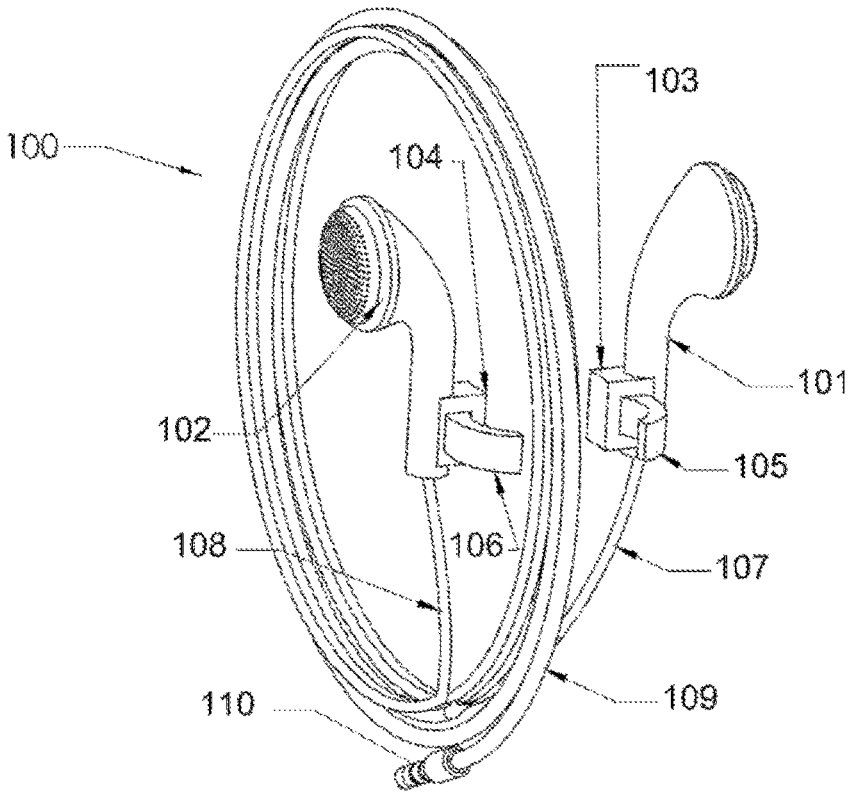
FIG. 2 is a perspective view of the headphone apparatus illustrated in FIGS. 1A and 1B with the first and second coupling devices unconnected.

FIGS. 1A, 1B, and 2 illustrate perspective, side, and perspective views of a headphone apparatus 100 embodying aspects of the present invention. In some embodiments, the headphone apparatus 100 may include a right transducer (e.g., earbud, earclip, earpiece, or in-ear headphone) 101 and a left transducer 102. Each transducer may have a mechanical housing. In some embodiments, the headphone apparatus 100 may include an audio connector (e.g., audio plug) 110, which enables the headphone apparatus 100 to connect to an audio device (e.g., mp3 player, mobile phone, laptop, radio, cd player, or tablet). When the headphone apparatus 100 is connected to the audio device (via the audio plug 110) and being used to play audio, the right and left transducers 101 and 102 may be inserted directly in the ear whereby audio can be heard.

In some embodiments, the housing of the right transducer 101 may have a right coupling device 103, and the housing of the left transducer 102 may have a left coupling device 104. For example, in one non-limiting embodiment, the right coupling device 103 may be affixed to the right transducer 101, and the left coupling device 104 may be affixed to the left transducer 102. The right and left coupling devices 103 and 104 may be configured to engage with each other. When engaged, the right and left coupling devices 103 and 104 may secure the right and left transducers 101 and 102 to each other. FIGS. 1A and 1B show the right and left coupling devices 103 and 104 engaged, and FIG. 2 shows the right and left coupling devices 103 and 104 unconnected. In some embodiments, the right and left coupling devices 103 and 104 may be configured to engage when brought in close proximity to one another. In some non-limiting embodiments, the right and left coupling devices 103 and 104 may be magnets. However, this is not required, and, in alternative embodiments, the coupling devices 103 and 104 could take other forms (e.g., any of the coupling devices described in U.S. Pat. No. 8,798,305, snaps, clasp devices, or interlocking connectors).

In some embodiments, the headphone apparatus 100 may include a right transducer wire 107, a left transducer wire 108, and a signal wire 109. The right transducer wire 107 may have an end connected to the right transducer 101, and the left transducer wire 108 may have an end connected to the left transducer 102. The other ends of the earbud wires 107 and 108 may be connected to one end of the signal wire 109, and the other end of the signal wire 109 may be connected to the audio plug 110.

In some embodiments, the headphone apparatus 100 may include a right clip 105 and a left clip 106. The right clip 105 may be connected to or part of the right transducer 101, and the left clip 106 may be connected to or part of the left transducer 102. In some embodiments, engagement of the right and left coupling devices 103 and 104 may create a structure (e.g., a clasping or clipping structure) capable of securing the right transducer wire 107, left transducer wire 108, signal wire 109, and/or audio connector 110. In some non-limiting embodiments, the right and left clip 105, 106 may form opposite halves of a loop or collar created when the right and left transducers 101, 102 are secured together. For instance, when the headphones are not being used to play audio, the right and left transducer wires 107 and 108 can be coiled along with the signal wire 109, as shown in FIGS. 1A and 1B.

To secure the coiled wires, the right and left coupling devices 103 and 104 may be connected so that the right and left clips 105 and 106 form a loop around the coiled wires (107, 108 and 109). The loop formed by the clips 105 and 106 may be sufficiently small so as to maintain pressure on the coiled wires and/or to prevent the audio connector 110 from passing through the loop when the right and left coupling devices 103 and 104 are connected. That is, in some embodiments, the inside dimension of the closed loop formed by the clips 105 and 106 may be selected so as to securely hold an expected number of coils (e.g., 4 to 8 coils) of wire having a known thickness.

In some embodiments, the headphone apparatus 100 may include a microphone and/or remote control (not pictured), which may be integrated with one of the right or left transducer wires 107 and 108.

As illustrated in FIG. 2, in some embodiments, when the right and left coupling devices 103 and 104 are disconnected, the coiled right 107, left 108, and signal 109 wires are not secured by the right and left clips 105 and 106, which may allow any of the right or left transducers 101 and 102 or audio connector 110 to move freely and potentially entangle any of the right or left earbud wires 107 and 108 or signal wire 109.

Figure 3A:
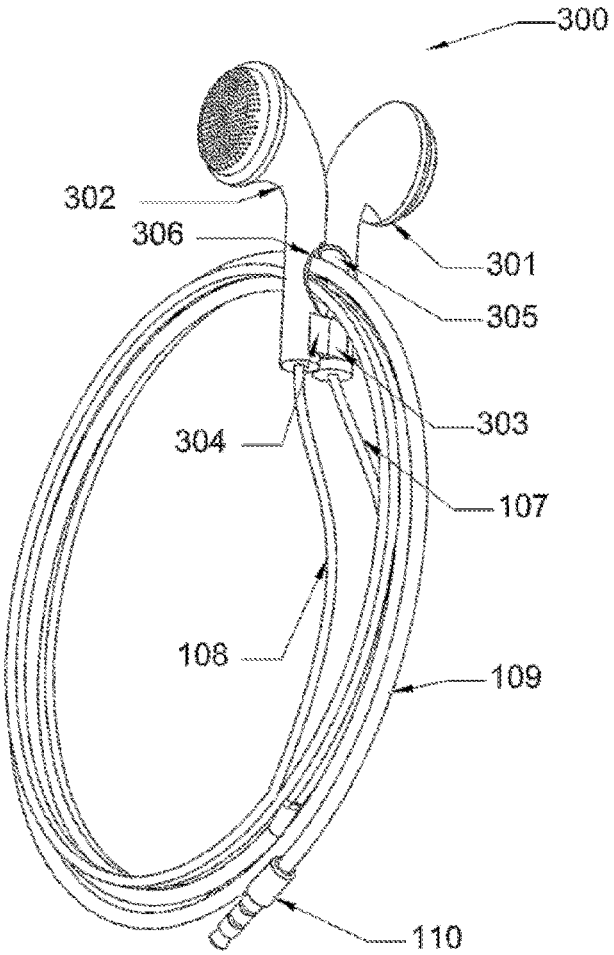
FIGS. 3A and 3B are perspective and side views, respectively, illustrating a headphone apparatus embodying aspects of the present invention with first and second coupling devices securing first and second transducers together and clips integrated in the transducer shape securing the headphone wire.
Figure 3B:
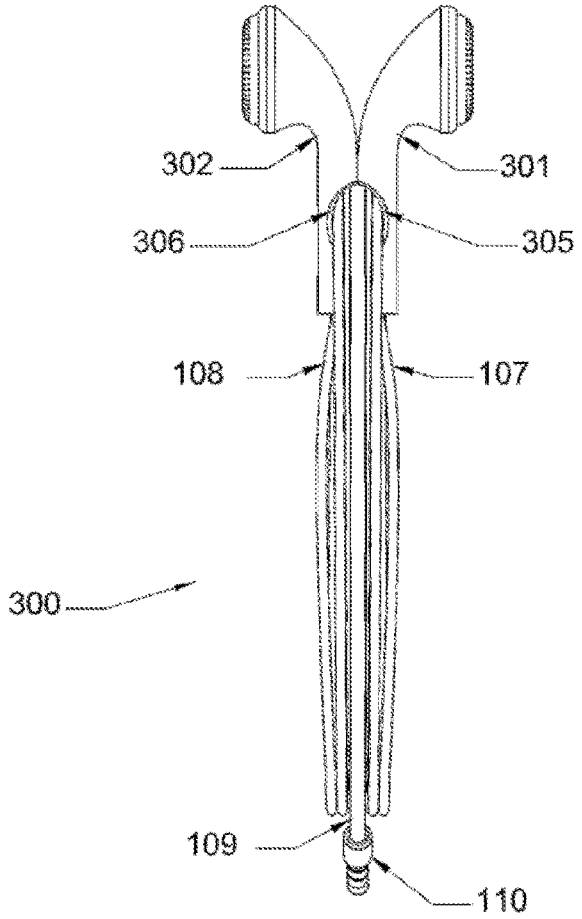
Figure 4:
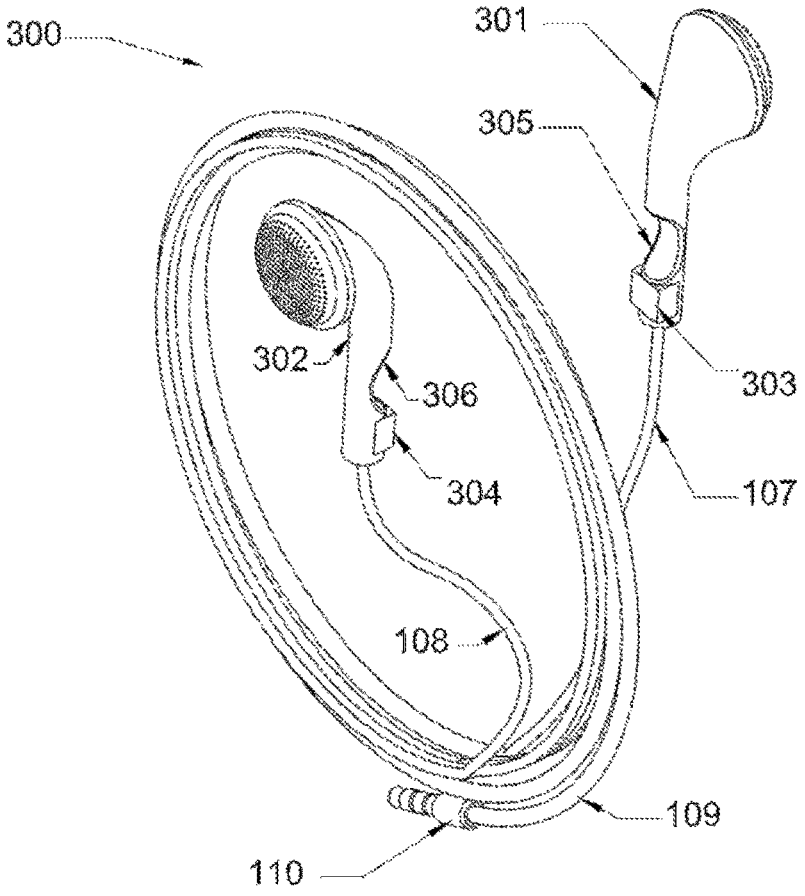
FIG. 4 is a perspective view of the headphone apparatus illustrated in FIGS. 3A and 3B with the first and second coupling devices unconnected.

FIGS. 3A, 3B, and 4 illustrate perspective, side, and perspective views, respectively, of a headphone apparatus 300 embodying aspects of the present invention. In some embodiments, the headphone apparatus 300 may include a right transducer (e.g., earbud, earclip, earpiece, or in-ear headphone) 301 and a left transducer 302. Each transducer may have a mechanical housing. In some embodiments, the housing of the right transducer 301 may have a right coupling device 303, and the housing of the left transducer 302 may have a left coupling device 304. For example, in one non-limiting embodiment, the right coupling device 303 may be affixed to the right transducer 301, and the left coupling device 304 may be affixed to the left transducer 302. The right and left coupling devices 303 and 304 may be configured to engage with each other. When engaged, the right and left coupling devices 303 and 304 may secure the right and left transducers 301 and 302 to each other. FIGS. 3A and 3B show the right and left coupling devices 303 and 304 engaged, and FIG. 4 shows the right and left coupling devices 303 and 304 unconnected. In some embodiments, the right and left coupling devices 303 and 304 may be configured to engage when brought in close proximity to one another. In some non-limiting embodiments, the right and left coupling devices 303 and 304 may be magnets. However, this is not required, and, in alternative embodiments, the right and left coupling devices 303 and 304 could be any other form of coupling device.

In some embodiments, the headphone apparatus 300 may include a right clip 305 and a left clip 306. The right clip 305 may be integrated into the shape of the right transducer 301 housing, and the left clip 306 may be integrated into the shape of the left transducer 302 housing. In some embodiments, engagement of the right and left coupling devices 303 and 304 may create a structure (e.g., a clasping structure) capable of securing the right transducer wire 107, left transducer wire 108, signal wire 109, and/or audio connector 110. For instance, when the headphones are not being used to play audio, the right and left transducer wires 107 and 108 can be coiled along with the signal wire 109, as shown in FIGS. 3A and 3B. The right and left clips 305 and 306 may each comprise a concave surface or edge of the mechanical housings of the transducer 301, 302, and the concave surfaces or edges may form opposite halves of a closed loop created when the transducers 301 and 302 are secured together.

To secure the coiled wires, the right and left coupling devices 303 and 304 are connected so that the right and left clips 305 and 306 form a loop around the coiled wires (107, 108 and 109). The loop formed by the clips 305 and 306 may be sufficiently small to maintain pressure on the coiled wires (e.g., based on the thickness of the wires of the number of loops a user might be expected to make) and/or to prevent the audio connector 110 from passing through the loop when the right and left coupling devices 303 and 304 are connected.

In some embodiments, the headphone apparatus 300 may include a microphone and/or remote control (not pictured), which may be integrated with one of the right or left earbud wires 107 and 108.

As illustrated in FIG. 4, in some embodiments, when the right and left coupling devices 303 and 304 are disconnected, the coiled right 107, left 108 and signal 109 wires are not secured by the right and left clips 305 and 306, which may allow any of the right or left earbuds 301 or 302 or audio connector 110 to move freely and potentially entangle any of the right or left transducer wires 107 or 108 or signal wire 109.

As shown in FIG. 3B, in various embodiments, the right and left coupling devices 303 and 304 may be constructed and arranged to hold the right and left transducers 301, 302 such that the respective housings of the transducers 301, 302 are in a back-to-back orientation with the housings contacting each other, except in the position of the right and left clips 305, 306. In addition, the right and left coupling devices 303, 304 may be positioned on the respective transducer housing beneath the right and left clips 305, 306. In some non-limiting embodiments, this arrangement may allow the wires 107, 108, 109 to be coiled over the top of the coupled transducers 301, 302 and pulled down between the transducers 301, 302. In these non-limiting embodiments, the coupling devices 303, 304 (e.g., magnets) may be configured to allow a slight separation between the housings of transducers 301, 302 as the wire is pulled down between the housings (e.g., a slight separation caused by the wire forcing the housings apart) to thereby allow the wire to be pulled into the loop formed by the right and left clips 305, 306. After the wire is pulled into the loop, the coupling devices 303, 304 may pull the housings of the transducers 301, 302 back into contact with each other, thereby closing the loop to prevent the wire from falling out of the loop.

In another embodiment, not shown, the housings and the coupling devices may be configured such that the coupling devices 303, 304 hold the transducer housings together in mutual contact beneath the loop formed by the clips 305, 306 with a small gap between the housings above the loop. Thus, the wires may be coiled over the top of the coupled transducers 301, 302 and pulled down between the transducers 301, 302 through the gap between the housings above the loop formed by the clips 305, 306. An ideal size of the gap may be determined based on the size (e.g., diameter) of the wire and the resiliency of the wire coating material. Thus, friction between the wire and the housings in the vicinity of the gap may be such as to permit a user to pull the wires into or out of the loop, but prevent the wires from simply falling through the gap.

Figure 5A:
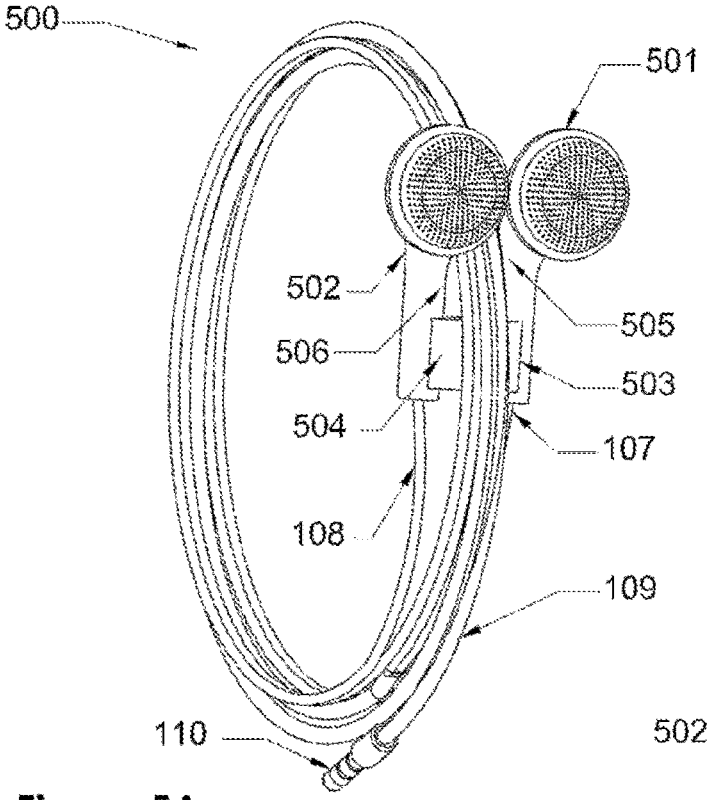
FIGS. 5A and 5B are perspective and side views, respectively, illustrating a headphone apparatus embodying aspects of the present invention with first and second coupling devices securing first and second transducers together and the housings of the first and second transducers securing the headphone wire.
Figure 5B:
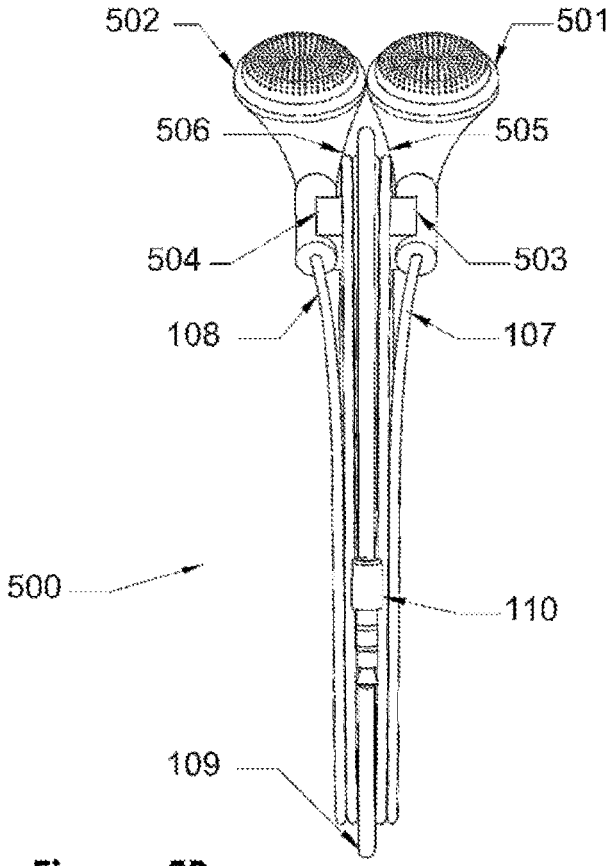
Figure 6:
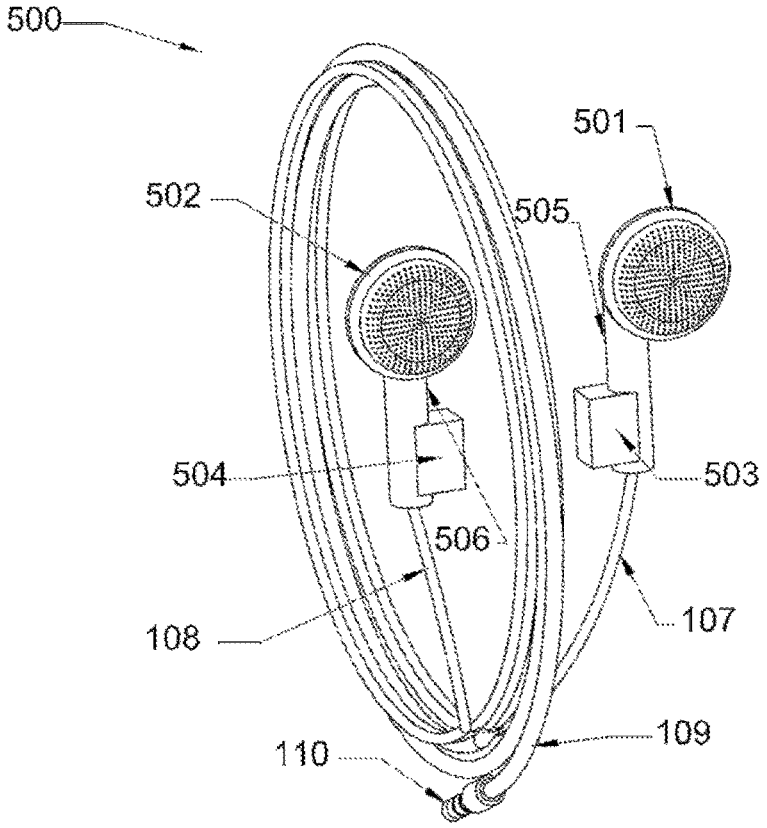
FIG. 6 is a perspective view of the headphone apparatus illustrated in FIGS. 5A and 5B with the first and second coupling devices unconnected.

FIGS. 5A, 5B, and 6 illustrate perspective, side, and perspective views, respectively, of a headphone apparatus 500 embodying aspects of the present invention. In some embodiments, the headphone apparatus 500 may include a right transducer (e.g., earbud, earclip, earpiece, or in-ear headphone) 501 and a left transducer 502. Each transducer may have a mechanical housing. In some embodiments, the housing of the right transducer 501 may have a right coupling device 503, and the housing of the left transducer 502 may have a left coupling device 504. For example, in one non-limiting embodiment, the right coupling device 503 may be affixed to the right transducer 501, and the left coupling device 504 may be affixed to the left transducer 502. The right and left coupling devices 503 and 504 may be configured to engage with each other. When engaged, the right and left coupling devices 503 and 504 may secure the right and left transducers 501 and 502 to each other. FIGS. 5A and 5B show the right and left coupling devices 503 and 504 engaged, and FIG. 6 shows the right and left coupling devices 503 and 504 unconnected. In some embodiments, the right and left coupling devices 503 and 504 may be configured to engage when brought in close proximity to one another. In some non-limiting embodiments, the right and left coupling devices 503 and 504 may be magnets. However, this is not required, and, in alternative embodiments, the coupling devices 503 and 504 could be any other form of coupling device.

In some embodiments, the headphone apparatus 500 may include a right clip 505 and a left clip 506. The right clip 505 may be formed by the shape of the right transducer 501, and the left clip 506 may be formed by the shape of the left transducer 502. In some embodiments, engagement of the right and left coupling devices 503 and 504 may create a structure capable of securing the right transducer wire 107, left transducer wire 108, signal wire 109, and/or audio connector 110. For instance, when the headphones are not being used to play audio, the right and left transducer wires 107 and 108 can be coiled along with the signal wire 109, as shown in FIGS. 5A and 5B. To secure the coiled wires, the right and left coupling devices 503 and 504 may be connected so that the right and left clips 505 and 506 form a loop around the coiled wires (107, 108 and 109). The loop formed by the clips 505 and 506 may be sufficiently small to maintain pressure on the coiled wires and/or to prevent the audio connector 110 from passing through the loop when the right and left coupling devices 503 and 504 are connected.

In some embodiments, the headphone apparatus 500 may include a microphone and/or remote control (not pictured), which may be integrated with one of the right or left transducer wires 107 and 108.

As illustrated in FIG. 6, in some embodiments, when the right and left coupling devices 503 and 504 are disconnected, the coiled right 107, left 108, and signal 109 wires are not secured by the right and left clips 605 and 606, which may allow any of the right or left transducers 501 or 502 or audio connector 110 to move freely and potentially entangle any of the right or left transducer wires 107 and 108 or signal wire 109.

As shown in FIG. 5B, in various embodiments, the right and left coupling devices 503 and 504 may be constructed and arranged to hold the right and left transducers 501, 502 such that the respective housings of the transducers 501, 502 are in a side-to-side orientation with the transducer housings contacting each other to form a loop including the right and left clips 505, 506 and the right and left coupling devices 503, 504. In addition, the right and left coupling devices 503, 504 may be positioned on the respective transducer housing beneath the right and left clips 505, 506. In some non-limiting embodiments, this arrangement may allow the wires 107, 108, 109 to be coiled over the top of the coupled transducers 501, 502 and pulled down between the transducers 501, 502. In these non-limiting embodiments, the coupling devices 503, 504 (e.g., magnets) may be configured to allow a slight separation between the housings of transducers 501, 502 as the wire is pulled down between the housings (e.g., a slight separation caused by the wire forcing the housings apart) to thereby allow the wire to be pulled into the loop formed by the right and left clips 305, 306 and the coupling devices 503, 504. After the wire is pulled into the loop, the coupling devices 503, 504 may pull the housings of the transducers 501, 502 back into contact with each other, thereby closing the loop to prevent the wire from falling out of the loop.

In another embodiment, not shown, the transducer housings and the coupling devices may be configured such that the coupling devices 503, 504 hold the transducer housings together in mutual contact beneath the loop formed by the clips 505, 506 with a small gap between the housings above the loop. Thus, the wires may be coiled over the top of the coupled transducers 501, 502 and pulled down between the transducers 501, 502 through the gap between the housings above the loop formed by the clips 505, 506. An ideal size of the gap may be determined based on the size (e.g., diameter) of the wire and the resiliency of the wire coating material. Thus, friction between the wire and the housings in the vicinity of the gap may be such as to permit a user to pull the wires into or out of the loop, but prevent the wires from simply falling through the gap. Additionally, in some non-limiting embodiments, a portion of the housings that create the gap may be tapered so as to guide the wires to the gap when the wire is pulled down between the transducers 501, 502.

Figure 7A:
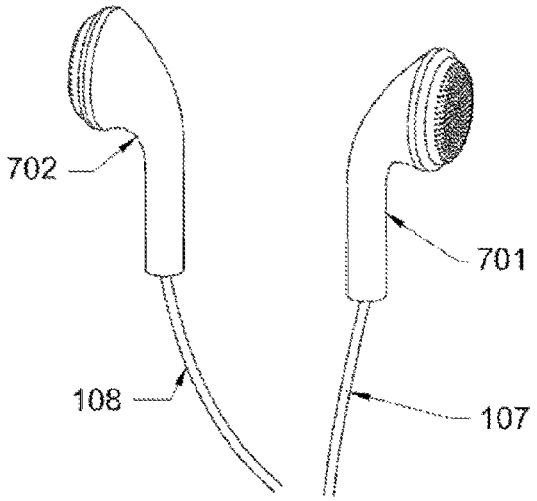
FIG. 7A is a perspective view illustrating a headphone apparatus.
Figure 7B:
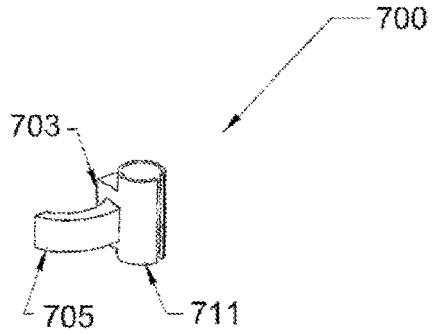
FIG. 7B is a perspective view illustrating an attachment apparatus embodying aspects of the present invention that may be configured to connect a first coupling device and clip to the headphone apparatus of FIG. 7A.
Figure 7C:
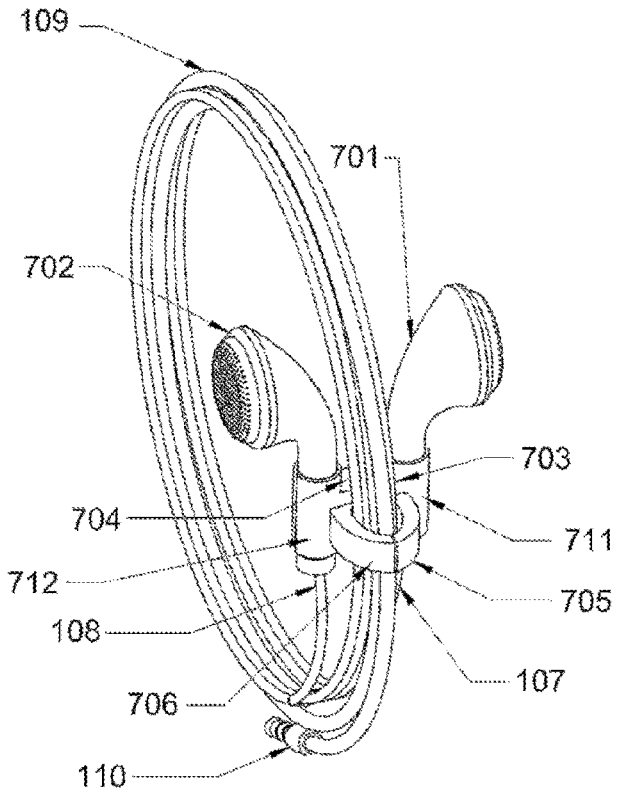
FIG. 7C is a perspective view illustrating first and second attachment apparatuses attaching first and second coupling devices and first and second clips, respectively, to the headphone apparatus of FIG. 7A, with first and second coupling devices securing first and second transducers together and clips on the coupling devices securing the headphone wire.

FIGS. 7A, 7B and 7C illustrate perspective views of a headphone apparatus, an attachment apparatus 700, and a modified headphone apparatus with two attachment apparatuses 700 attached, respectively, embodying aspects of the present invention. In some embodiments, as illustrated in FIG. 7A, the headphone apparatus may include a right transducer (e.g., earbud, earclip, earpiece, or in-ear headphone) 701 and a left transducer 702. The right transducer 701 may be connected to a right transducer wire 107, and the left transducer 702 may be connected to a left transducer wire 108. In some embodiments, the headphone apparatus may include a signal wire 109, and/or audio connector 110 (not pictured in FIG. 7A).

In some embodiments, the attachment apparatus 700 may be a right attachment apparatus. As illustrated in FIG. 7B, in some embodiments, the right attachment apparatus 700 may include one or more of a right attachment device 711, a right coupling device 703, and a right clip 705. In some embodiments, the attachment apparatus 700 may be configured to attach to a headphone apparatus such as, for example, the headphone apparatus of FIG. 7A.

In some embodiments, one or more attachment apparatuses 700 may be attached to a headphone apparatus. For example, as illustrated in FIG. 7C, in some embodiments, right and left attachment apparatuses may be attached to the headphone apparatus of FIG. 7A. In some embodiments, the modified headphone apparatus may include right and left attachment devices 711 and 712, which may attach to the housing of the right and left transducers 701 and 702, respectively. For example, in one non-limiting embodiment, the right attachment device 711 may attach to the right transducer 701, and the left attachment device 712 attach to the left transducer 702. In some non-limiting embodiments, the right and left attachment devices 711 and 712 may permanently or removeably attach to the transducers 701 and 702 through an adhesive and/or by means of friction. In some embodiments, the right attachment device 711 may comprise a space (as shown in FIG. 7B) through which a right transducer wire 107 may pass so that the right attachment device 711 may slide onto the right transducer 701. Similarly, in some embodiments, the left attachment device 712 may comprise a space (as shown in FIG. 7C) through which a left transducer wire 108 may pass so that the left attachment device 712 may slide onto the left transducer 702.

As illustrated in FIG. 7C, in some embodiments, the right and left attachment devices 711 and 712 may be attached to right and left coupling devices 703 and 704, respectively. In some embodiments, the right and left coupling devices 703 and 704 may be configured to engage with each other. When engaged, the right and left coupling devices 703 and 704 may secure the right and left transducers 701 and 702 to each other. FIG. 7C shows the right and left coupling devices 703 and 704 engaged. In some embodiments, the right and left coupling devices 703 and 704 may be configured to engage when brought in close proximity to one another. In some non-limiting embodiments, the right and left coupling devices 703 and 704 may be magnets. However, this is not required, and, in alternative embodiments, the coupling devices 703 and 704 could be any other form of coupling device.

In some embodiments, the right and left attachment apparatuses may include a right clip 705 and a left clip 706, respectively. In some embodiments, engagement of the right and left coupling devices 703 and 704 may create a structure capable of securing the right transducer wire 107, left transducer wire 108, signal wire 109, and/or audio connector 110. For instance, when the headphones are not being used to play audio, the right and left transducer wires 107 and 108 can be coiled along with the signal wire 109, as shown in FIG. 7C. To secure the coiled wires, the right and left coupling devices 703 and 704 may be connected so that the right and left clips 705 and 706 form a loop around the coiled wires (107, 108 and 109). The loop formed by the clips 705 and 706 may be sufficiently small to maintain pressure on the coiled wires and/or to prevent the audio connector 110 from passing through the loop when the right and left coupling devices 703 and 704 are connected. In some alternative embodiments (not pictured), the right and left attachment apparatuses may instead be configured so a right clip 705 may be formed by the shape of the right transducer 701 and a left clip 706 may be formed by the shape of the left transducer 702 when the attachment apparatuses are attached to the headphone apparatus of FIG. 7A (e.g., similar to the clips 505 and 506 shown in FIGS. 5A, 5B and 6).

In some non-limiting embodiments, the headphone apparatus of FIG. 7A may include a microphone and/or remote control (not pictured), which may be integrated with one of the right or left transducer wires 107 and 108.

Figure 8A:
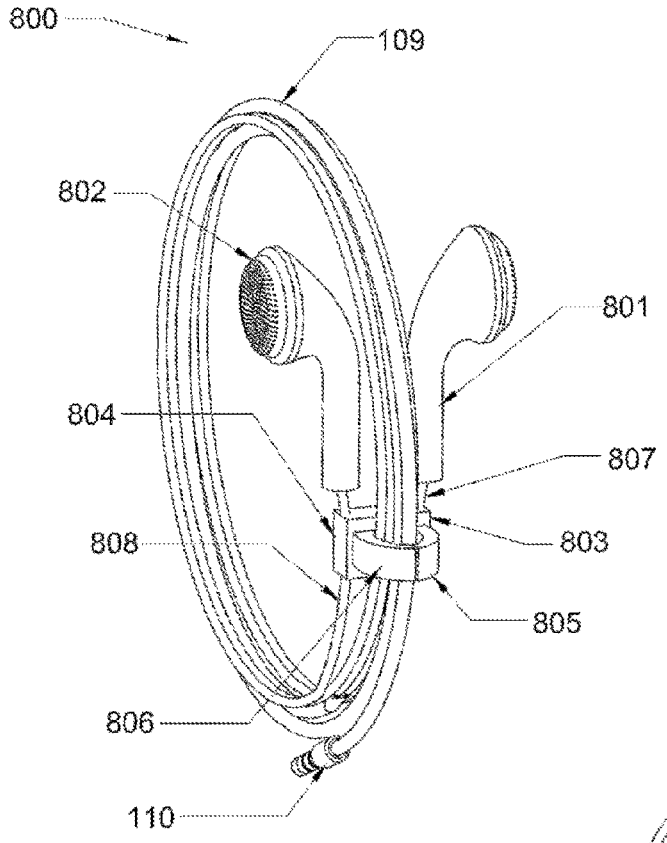
FIG. 8A is a perspective view illustrating a headphone apparatus embodying aspects of the present invention with first and second coupling devices securing first and second transducer wires together and clips on the coupling devices securing the headphone wire.
Figure 8B:
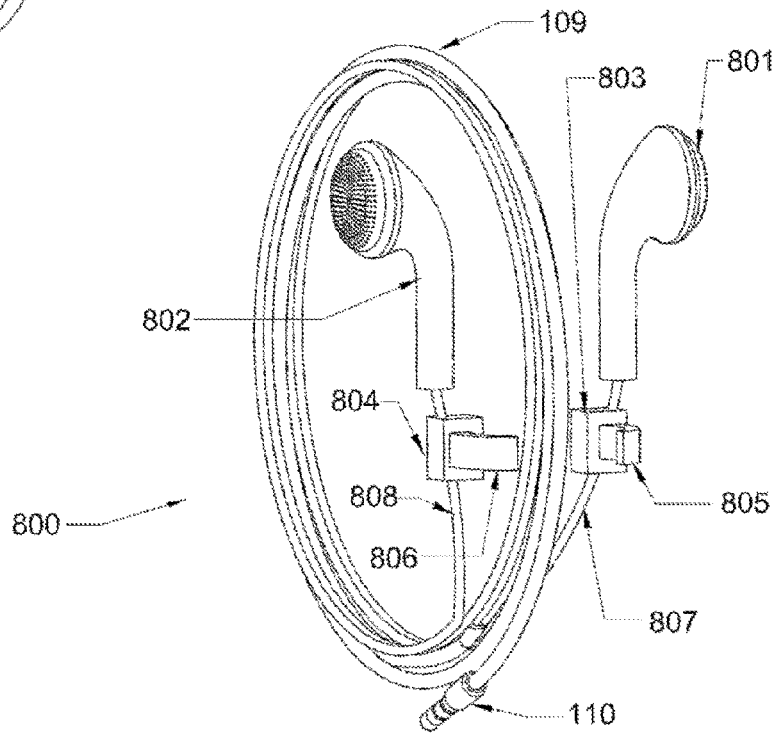
FIG. 8B is a perspective view of the headphone apparatus illustrated in FIG. 8A with the first and second coupling devices unconnected.

FIGS. 8A and 8B illustrate perspective views of a headphone apparatus 800 embodying aspects of the present invention. In some embodiments, the headphone apparatus 800 may include a right transducer (e.g., earbud, earclip, earpiece, or in-ear headphone) 801 and a left transducer 802. The right transducer 801 may be connected to a right transducer wire 807 and the left transducer 802 may be connected to a left transducer wire 808. In some embodiments, the right transducer wire 807 may have a right coupling device 803, and the left transducer wire 808 may have a left coupling device 804. For example, in one non-limiting embodiment, the right coupling device 803 may be affixed to the right transducer wire 807, and the left coupling device 804 may be affixed to the left transducer wire 808. In some embodiments, the right and left coupling devices 803 and 804 may be configured to engage with each other. When engaged, the right and left coupling devices 803 and 804 may secure the right and left transducer wires 807 and 808 to each other, thereby limiting the movement of the first and second transducers 801 and 802 with respect to each other. FIG. 8A shows the right and left coupling devices 803 and 804 engaged, and FIG. 8B shows the right and left coupling devices 803 and 804 unconnected. In some embodiments, the right and left coupling devices 803 and 804 may be configured to engage when brought in close proximity to one another. In some non-limiting embodiments, the right and left coupling devices 803 and 804 may be magnets. However, this is not required, and, in alternative embodiments, the coupling devices 803 and 804 could be any other form of coupling device.

In some embodiments, the headphone apparatus 800 may include a right clip 805 and a left clip 806. In some embodiments, engagement of the right and left coupling devices 803 and 804 may create a structure capable of securing the right transducer wire 807, left transducer wire 808, signal wire 109, and/or audio connector 110. For instance, when the headphones are not being used to play audio, the right and left transducer wires 807 and 808 can be coiled along with the signal wire 109, as shown in FIG. 8A. To secure the coiled wires, the right and left coupling devices 803 and 804 may be connected so that the right and left clips 805 and 806 form a loop around the coiled wires (807, 808 and 109). The loop formed by the clips 805 and 806 may be sufficiently small to maintain pressure on the coiled wires and/or to prevent the audio connector 110 from passing through the loop when the right and left coupling devices 803 and 804 are connected.

In some embodiments, the headphone apparatus 800 may include a microphone and/or remote control (not pictured), which may be integrated with one of the right or left transducer wires 807 and 808.

As illustrated in FIG. 8B, in some embodiments, when the right and left coupling devices 803 and 804 are disconnected, the coiled right 807, left 808, and signal 109 wires are not secured by the right and left clips 805 and 806, which may allow any of the right or left transducers 801 or 802 or audio connector 110 to move freely and potentially entangle any of the right or left transducer wires 807 and 808 or signal wire 109.

Although in some of the embodiments described above, the headphone apparatus may secure coiled headphone wires (e.g., right and left transducer wires 107 and 108 and signal wire 109), this is not required. In some alternative embodiments, the loop created by the coupling of the transducers (e.g., transducers 101 and 102, transducers 301 and 302, transducers 501 and 502) and the clips (e.g., clips 105 and 106, clips 305 and 306, or clips 505 and 506) may be small enough to secure only one width of wire. In these embodiments, the portion of the signal wire 109 closest to the audio connector 110 may be gripped and secured by the clips, and the gripping of this portion of the signal wire 109 may effectively create a continuous loop in the wire and, thus, reduce the likelihood the wires will tangle or knot. In another alternative embodiment, the clips may be configured to grip and/or secure only the connector 110 to essentially create a continuous loop in the wire, and, thus, reduce the likelihood the wires will tangle or knot.

In some alternative embodiments, the headphone apparatus (e.g., apparatus 100, apparatus 300, or apparatus 500) may include a means of stabilizing or strengthening the connection between the wire and the right and left clips. For example, such means may include, but are not limited to, wires with adhesives integrated into their surfaces, clips with adhesives on their surfaces, and/or magnets in the clips which are attracted to a material in the headphone wire.

In some alternative embodiments, the headphone apparatus may include two or more additional coupling devices integrated into the clips themselves. These additional coupling devices can be instead of or in addition to the transducer coupling devices. In these embodiments, when the earbuds are connected, the ends of the clips may also connect (e.g., by means of magnetic force or a snap).

In some alternative embodiments, the headphone apparatus may include a clip system whereby the right clip and left clip are different but complimentary in shape. Several clip shapes could be used to achieve the loop described above, including, but not limited to hooks and loops, a peg and loop or snaps. Furthermore, these clips can be either rigid or flexible.

In some alternative embodiments, the headphone apparatus may have the ability to wirelessly connect to an audio or video device. In these wireless embodiments, the transducers may be connected to one another by a wire (e.g., a wire that transmits a signal or a wire that is simply be used to connect the transducers for convenience and portability). These headphone wires can similarly be coiled and secured using aspects of the present invention.

Moreover, in the various embodiments described herein, any suitable coupling device or devices can be employed to couple the right and left transducers together in accordance with the invention, including those described in U.S. Pat. No. 8,798,305, snaps, various clasp devices, interlocking connectors and the like. For example, the coupling device or devices can be permanently or removably affixed to the transducer or can be incorporated into or made a part of the construction of the transducer itself. For another example, the first coupling device may be separate from the first mechanical housing and first transducer, and the second coupling device is separate from the second mechanical housing and second transducer.

The foregoing disclosure of the various embodiments of the present invention has been presented for purposes of illustration and description. It is not intended to be exhaustive or to limit the invention to the precise forms disclosed. Many variations and modifications of the embodiments described herein will be obvious to one of ordinary skill in the art given the above disclosure. The scope of the invention is to be defined only by the claims and by their equivalents.

What is claimed is:

1. A headphone apparatus comprising:

a wire;

a first transducer having a first mechanical housing that includes a first coupling device; and a second transducer having a second mechanical housing that includes a second coupling device configured to engage with the first coupling device;

wherein the first and second coupling devices are configured such that engagement of the first and second coupling devices (i) secures the first and second transducers to each other and (ii) creates a structure capable of confining at least a portion of the wire by means of friction between the structure and the wire when the first and second coupling devices are engaged.

2. The apparatus of claim 1, wherein the structure capable of confining at least the portion of the wire comprises a first clip and a second clip.

3. The apparatus of claim 2, wherein the first clip is integrated into the shape of the first mechanical housing of the first transducer, and the second clip is integrated into the shape of the second mechanical housing of the second transducer.

4. The apparatus of claim 2, wherein the structure capable of confining at least the portion of the wire comprises a closed loop configured to confine at least the portion of the wire, and the first and second clips form all or a portion of the closed loop.

5. The apparatus of claim 4, further comprising an audio connector connected to the wire, wherein neither the portion of the wire nor the audio connector is capable of passing out of the closed loop.

6. The apparatus of claim 2, wherein said first coupling device comprises the first clip, and the second coupling device comprises the second clip.

7. The apparatus of claim 2, wherein the clip is permanently or removeably affixed to one or both of the first and second mechanical housings.

8. The apparatus of claim 2, wherein the clip is permanently or removeably affixed or integrated to one or both of the first and second coupling devices.

9. The apparatus of claim 1, wherein at least one of said first coupling device and said second coupling device comprises a magnet.

10. The apparatus of claim 1, wherein said first coupling device comprises a first magnet, said second coupling device comprises a second magnet, and the polarities of said first magnet and said second magnet are opposite and attractive.

11. The apparatus of claim 1, wherein said first coupling device is configured to couple to said second coupling device in a specific orientation.

12. The apparatus of claim 1, wherein said first and second coupling devices are different but interlocking.

13. The apparatus of claim 1, wherein said first coupling device is configured to couple to said second coupling device at two or more points.

14. The apparatus of claim 1, wherein a surface of said first coupling device and a surface of said second coupling device are distinct but complementary.

15. The apparatus of claim 1, wherein the engagement of the first and second coupling devices is temporary.

16. The apparatus of claim 1, wherein the first and second coupling devices are configured to engage when in close proximity to each other.

17. The apparatus of claim 1, wherein the first coupling device is permanently or removably affixed to the first mechanical housing, and the second coupling device is permanently or removably affixed to the second mechanical housing.

18. A system for modifying a preexisting headphone apparatus, the system comprising:

a first attachment apparatus configured to be permanently or removeably attached to a mechanical housing of a first headphone transducer, wherein the first attachment apparatus includes a first coupling device; and a second attachment apparatus configured to be permanently or removeably attached to a mechanical housing of a second headphone transducer, wherein the second attachment apparatus includes a second coupling device;

wherein the first coupling device is configured to engage with the second coupling device;

wherein the first and second coupling devices are configured such that engagement of the first and second coupling devices creates a structure capable of confining at least a portion of a wire connected to at least one of the first and second headphone transducers by means of friction between the structure and the wire when the first and second coupling devices are engaged.

19. The system of claim 18, wherein the first attachment apparatus comprises a first clip, the second attachment apparatus comprises a second clip, and the structure capable of confining at least the portion of the wire comprises the first clip and the second clip.

20. A headphone apparatus comprising:

a signal wire;

a first transducer wire including a first coupling device;

a first transducer connected to the first transducer wire;

a second transducer wire including a second coupling device configured to engage with the first coupling device; and a second transducer connected to the second transducer wire;

wherein the first and second coupling devices are configured such that engagement of the first and second coupling devices (i) secures at least a portion of the first and second transducer wires to each other, thereby limiting the movement of the first and second transducers with respect to each other and (ii) creates a structure capable of confining at least a portion of the signal wire by means of friction between the structure and the signal wire when the first and second coupling devices are engaged.

21. The apparatus of claim 20, wherein the structure capable of confining at least the portion of the signal wire comprises a first clip and a second clip.

22. The apparatus of claim 21, wherein the structure capable of confining at least the portion of the signal wire comprises a closed loop configured to confine the signal wire, and the first and second clips form all or a portion of the closed loop.

23. The apparatus of claim 22, further comprising an audio connector connected to the signal wire, wherein neither the portion of the signal wire nor the audio connector is capable of passing out of the closed loop.

24. The apparatus of claim 21, wherein said first coupling device comprises the first clip, and the second coupling device comprises the second clip.

25. The apparatus of claim 21, wherein the first clip is permanently or removeably affixed or integrated to one or both of the first and second coupling devices.

26. The apparatus of claim 20, wherein at least one of said first coupling device and said second coupling device comprises a magnet.

27. The apparatus of claim 20, wherein said first coupling device comprises a first magnet, said second coupling device comprises a second magnet, and the polarities of said first magnet and said second magnet are opposite and attractive.

28. The apparatus of claim 20, wherein said first coupling device is configured to couple to said second coupling device in a specific orientation.

29. The apparatus of claim 20, wherein the first coupling device is permanently or removably affixed to the first transducer wire, and the second coupling device is permanently or removably affixed to the second transducer wire.

* * * * *